US006862832B2

(12) United States Patent
Barrett

(10) Patent No.: US 6,862,832 B2
(45) Date of Patent: Mar. 8, 2005

(54) DIGITAL ELEVATION KNOB

(76) Inventor: Ronnie G. Barrett, P.O. Box 1077, Murfreesboro, TN (US) 37133

( * ) Notice: Subject to any disclaimer, the term of this patent is extended or adjusted under 35 U.S.C. 154(b) by 242 days.

(21) Appl. No.: 10/620,693

(22) Filed: Jul. 17, 2003

(65) Prior Publication Data

US 2004/0088898 A1 May 13, 2004

Related U.S. Application Data

(60) Provisional application No. 60/396,244, filed on Jul. 17, 2002.

(51) Int. Cl.[7] ..... F41G 1/38

(52) U.S. Cl. ..... 42/119; 42/125; 33/245; 33/246; 33/248

(58) Field of Search ..... 42/119, 120, 122, 42/125, 136; 33/245, 248, 246

(56) References Cited

U.S. PATENT DOCUMENTS

| | | | | |
|---|---|---|---|---|
| 3,990,155 A | | 11/1976 | Akin, Jr. et al. | 33/247 |
| 4,038,757 A | | 8/1977 | Hicks et al. | 32/247 |
| 4,142,139 A | | 2/1979 | Slaats et al. | 318/603 |
| 4,543,526 A | | 9/1985 | Burckhardt et al. | 324/61 R |
| 4,554,745 A | | 11/1985 | Repa | 33/257 |
| 5,141,313 A | | 8/1992 | Brun | 356/251 |
| 5,375,072 A | | 12/1994 | Cohen | 364/561 |
| 5,528,847 A | | 6/1996 | Fisher et al. | 42/101 |
| 6,269,581 B1 | * | 8/2001 | Groh | 42/122 |
| 6,516,699 B2 | * | 2/2003 | Sammut et al. | 89/41.17 |

* cited by examiner

*Primary Examiner*—J. Woodrow Eldred
(74) *Attorney, Agent, or Firm*—Richard C. Litman

(57) ABSTRACT

The digital elevation knob is a digital replacement for a conventional elevation knob of a telescopic rifle sight. The knob is mounted to the rifle scope by a cylindrical body having a pair of flanges. The flanges are adapted for securing a microcomputer to the knob. A display screen is disposed on the front surface of the microcomputer. Inputs supply data to the microcomputer that processes the data. When the elevation knob is turned it turns a screw that is secured to a targeting element. The screw causes the targeting element to move vertically. A displacement sensor determines how much the targeting element has moved and sends a signal to the microcomputer. The input data and the information from the sensor are processed using trajectory programs and ballistic tables. The results of the data processing are projected on the display screen. The display informs the rifleperson of necessary adjustments.

16 Claims, 6 Drawing Sheets

DIGITAL ELEVATION KNOB

CROSS REFERENCE TO RELATED APPLICATION

This application claims the benefit of U.S. Provisional Patent Application Ser. No. 60/396,244, filed Jul. 17, 2002.

BACKGROUND OF THE INVENTION

1. Field of the Invention

The present invention relates generally to riflescopes and, more specifically, to a digital elevation knob, for replacement of a conventional elevation knob.

2. Description of the Related Art

Rifles and other guns are typically equipped with telescopes for improving the hunter's targeting. The telescopes provide elevation knobs for adjusting the sight and other variables of the telescope. Presently, conventional elevation knobs on rifle telescopes have engraved or painted graduation marks to indicate adjustment of the scope. In order to relate these marks to the hunter's rifle the hunter must equate ballistic data. A separate ballistic sheet is needed for each variable including caliber, bullet speed, temperature, etc. The relevant art of interest describes various aligning elements for an adjustable telescopic rifle sight, but none disclose the present invention. There is a need for a digital elevation knob, retrofittable to a telescopic sight, which can be programmed for various parameters and readouts on a display screen. The relevant art will be discussed in the order of perceived relevance to the present invention.

U.S. Pat. No. 5,375,072 issued on Dec. 20, 1994, to Stephen E. Cohen describes a microcomputer device with a triangulation rangefinder for a firearm trajectory compensation comprising a computerized instrument for displacing the aiming mark of a rifle or other small arms to compensate for ballistic trajectory. The device has means for retaining data for several types of small arms ammunition, a ballistics data program, an electric aiming mark displacement system, and a display system for the outputted aiming mark adjustment data controlled by timer devices and a battery. The device is distinguishable for its integration directly with a telescopic sight and its requirement for triangulation, timers and a battery.

U.S. Pat. No. 4,142,139 issued on Feb. 27, 1979, to Mathew A. Slaats et al. describes a search mount for a telescope comprising a motorized telescope mount with an array of buttons for entering elevation and windage settings and a digital signaling system. The digital circuitry includes a paper tape reader, a magnetic card reader, and a two-position display system with one display showing the present position of the horizontal motor, and the second display showing the data entered by the user. A photocell and lamp are used for each of two motors to count the number of revolutions of the motor shafts. The device is distinguishable for its motorized mount, manual switches, photocells, lamps, and readers for a paper tape and a magnetic card.

U.S. Pat. No. 4,554,745 issued on Nov. 26, 1985, to Otto Repa describes a device for aligning an adjustable sight element for a rifle comprising a battery driven digital eyepiece attachment that visually indicates at all times the magnitude of horizontal and vertical movement of the adjustable sight element. The device is distinguishable for its limited capability.

U.S. Pat. No. 3,990,155 issued on Nov. 9, 1976, to Alfred A. Akin, Jr. et al. describes a riflescope elevation assembly integrated with the riflescope that reads target distance directly and provides conventional "click" elevation settings. A knob having a distance scale on its skirt is viewed through an opening in the elevation adjustable assembly. The device is distinguishable for its limitation to manual elevation settings.

U.S. Pat. No. 4,038,757 issued on Aug. 2, 1977, to Edward H. Hicks et al. describes two external adjustment knobs with a cylindrical body attached to a telescopic sight that cooperate with the adjustment screw that forms a part of the sight. The device is limited to manual operation of the riflescope's windage and elevation adjustment screws absent the conventional cap.

U.S. Pat. No. 5,141,313 issued on Aug. 25, 1992, to Robert Brun describes an apparatus for producing a collimating mark within an optical sighting device which includes a light source to generate a light beam for the mark, imaging optics and a beam splitter. The apparatus is distinguishable for being limited to enhancing optics.

U.S. Pat. No. 5,528,847 issued on Jun. 25, 1996, to Timothy D. Fisher et al. describes a variable power telescopic sight device comprising an externally located zoom adjusting ring rotatable about the sighting means' axis and modified to provide a digitally-activated zooming feature. The device is distinguishable for its required zooming structure.

None of the above inventions and patents, taken either singly or in combination, is seen to describe the instant invention as claimed. Thus a digital elevation knob solving the aforementioned problems is desired.

SUMMARY OF THE INVENTION

The present invention is a digital elevation knob for replacement of a conventional elevation knob on a telescopic rifle sight. The digital elevation knob may be built onto a new riflescope or be made to retrofit onto an existing riflescope. The digital elevation knob has a displacement sensor, a unit containing elevation programs for different ammunition, and a battery operated display screen. The digital elevation knob is mounted to a conventional riflescope. The knob is mounted to the riflescope by a generally cylindrical body having a pair of flanges. The flanges are adapted for securing a microcomputer to the elevation knob. The display screen is disposed on the front surface of the microcomputer.

A plurality of inputs supply information to the microcomputer. The information is input into the microcomputer through either a communications port or through the keyboard on the microcomputer. The input information is sent to a central processing unit where it is stored and processed. The input information contains several variables including, but not limited to, environmental conditions, ammunition data, measurement units and target data.

The elevation knob is turned, which turns a screw that is secured to a targeting element. The screw causes the targeting element to move up and down. The displacement sensor determines how much the targeting element has moved and sends a signal to the microcomputer. A weapon lay sensor also determines the pitch and cant of the gun and sends another signal to the microcomputer. These signals are sent to the central processing unit and are processed with the input information. The input information and the information from the sensor are entered into data storage and several calculations are made using trajectory programs and ballistic tables. The results of the data processing are projected on the readout display screen on the front of the microcomputer. The readout displays the corrected range and informs the user of the rifle of any adjustments that need to be made.

Accordingly, it is a principal object of the invention to provide a digital elevation knob for a telescopic rifle sight.

It is another object of the invention to provide a retrofittable digital elevation knob device having a display screen.

It is a further object of the invention to provide a digital elevation knob device having a peripherally located displacement sensor.

Still another object of the invention is to provide a digital elevation knob device having a unit containing elevation programs for different ammunition.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
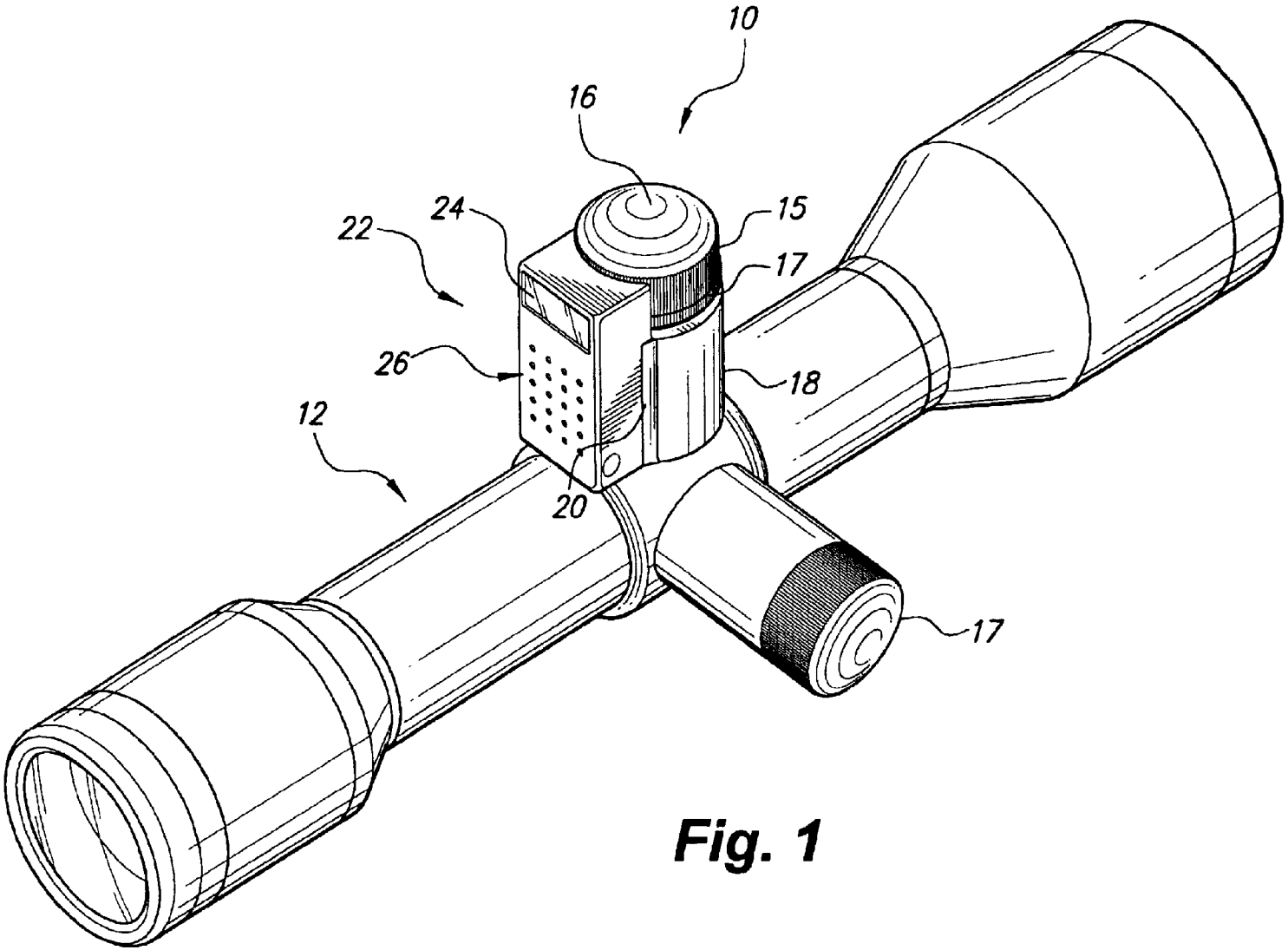
FIG. 1 is an environmental, perspective view of a digital elevation knob on a rifle telescopic sight according to the present invention.
Figure 2:
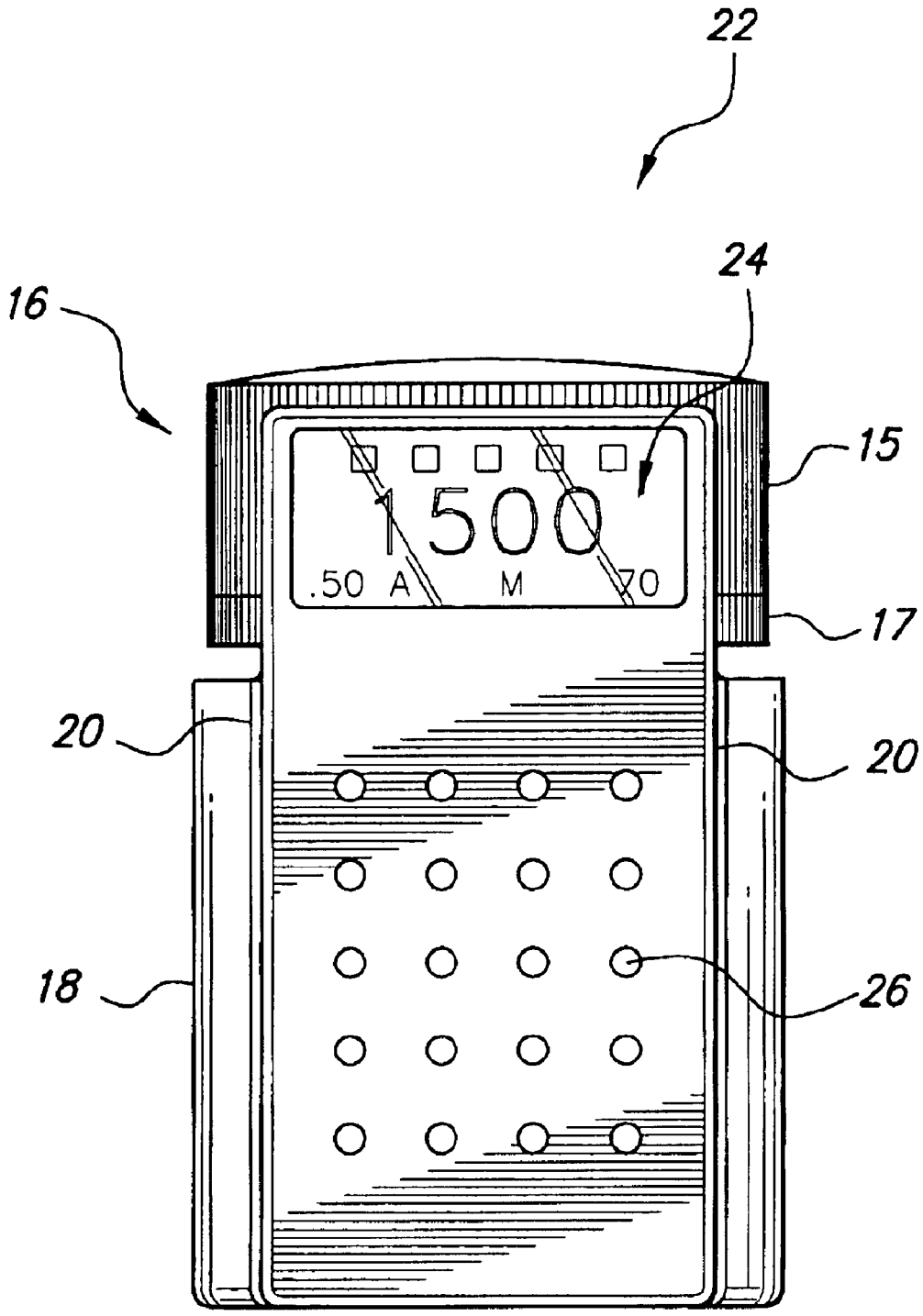
FIG. 2 is a front elevational view of the digital elevation knob.
Figure 3:
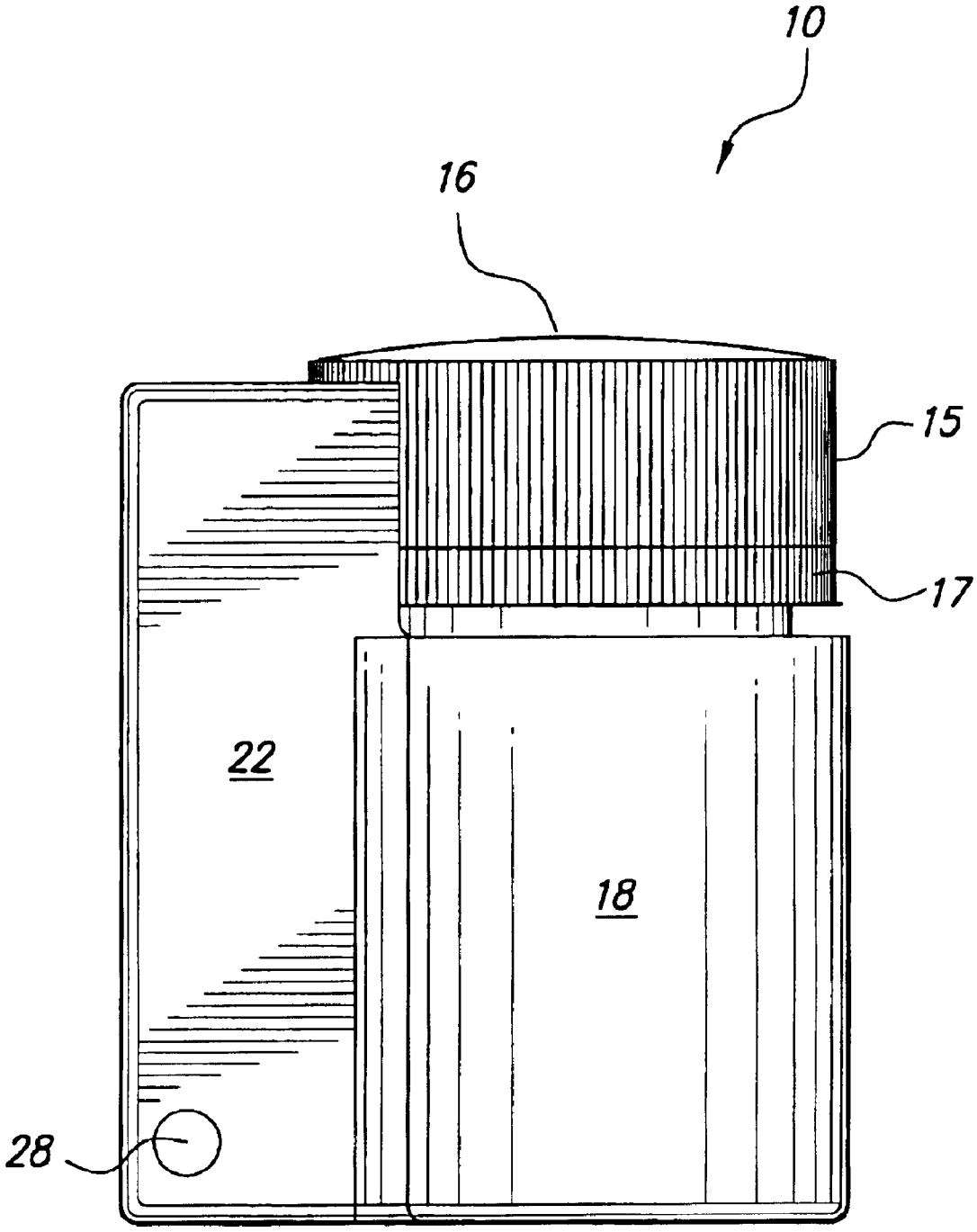
FIG. 3 is a side elevational view of the digital elevation knob.
Figure 4:
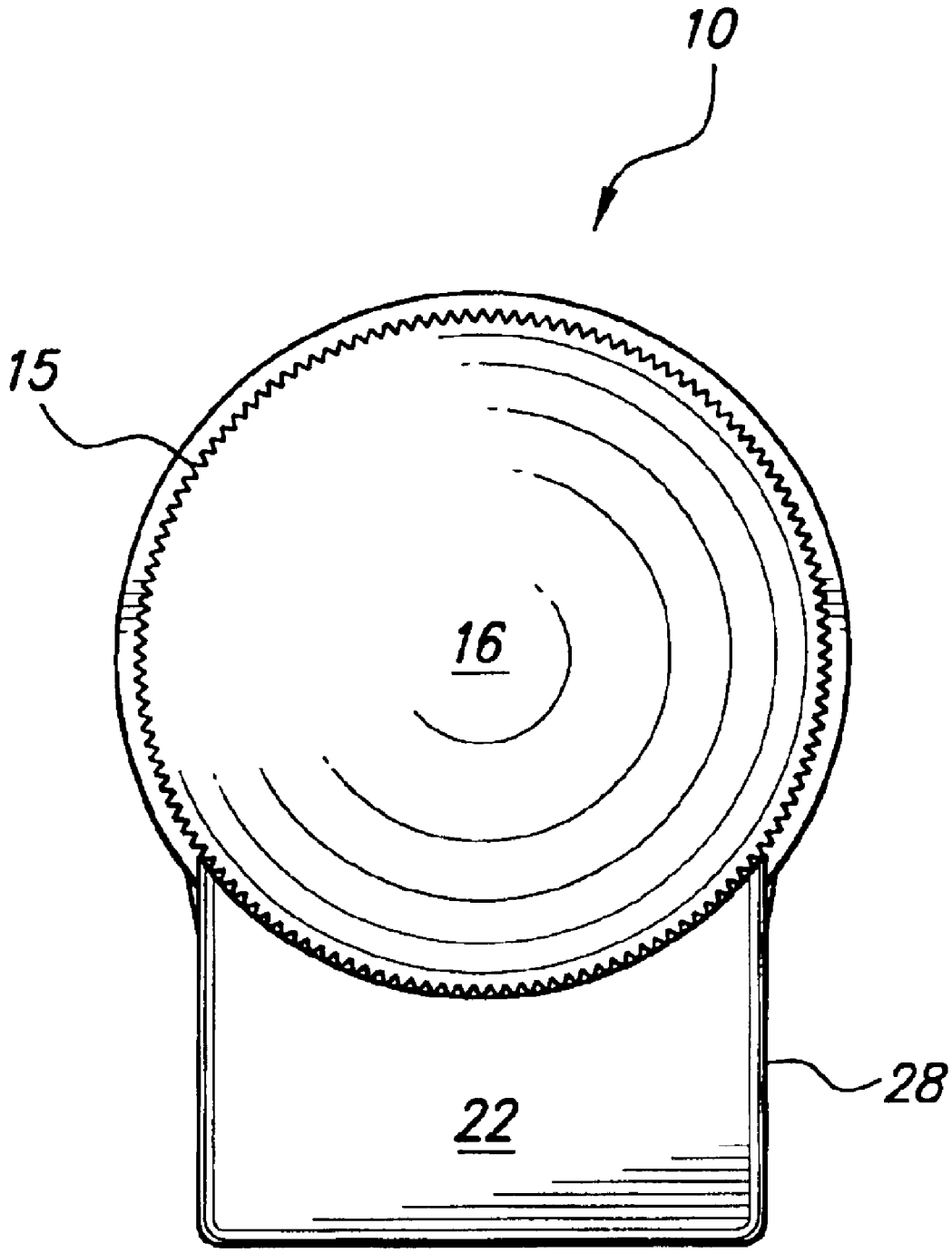
FIG. 4 is a top view of the digital elevation knob.

In FIGS. 1 through 4, the present invention is directed to a digital elevation knob device 10 for a telescopic sight 12 (FIG. 1) for a rifle, long barreled pistol, or any other form of sighted weapon. A conventional horizontal adjustment knob 14 is utilized for wind and sight adjustment. The device 10 comprises a cylindrical ribbed knob element 16 for replacement of a conventional elevation knob. The ribbed knob is inserted into a non-rotating cylindrical body 18 having a longitudinal axis coincident with the cylindrical ribbed knob element 16 and a longitudinally arranged pair of flanges 20 (FIGS. 1, 3 and 4). The rotatable knob 16 communicates with a microcomputer 22 (FIGS. 1–3) in the microcomputer 22 housing. According to preferred embodiments of the present invention the microcomputer 22 is secured to the device 10 by the flanges 20. The microcomputer 22, however, is not limited to being mounted to the riflescope in this manner and the microcomputer 22 may also be remote from the riflescope.

As FIG. 2 illustrates, a generally rectangular microcomputer 22 is attached to the non-rotating body 18 and includes a programmable computer energized by a watch-type battery or other power source (hidden). A display screen 24 in an upper portion of the microcomputer 22 indicates informative data including: (1) distance; (2) caliber of ammunition; (3) program numbers being used; (4) temperature; and other pertinent information such as direction and firing times. The display screen 24 may be any suitable type of screen including, but not limited to, liquid crystal display (LCD), laser emitting diode (LED), and plasma screens.

Figure 5:
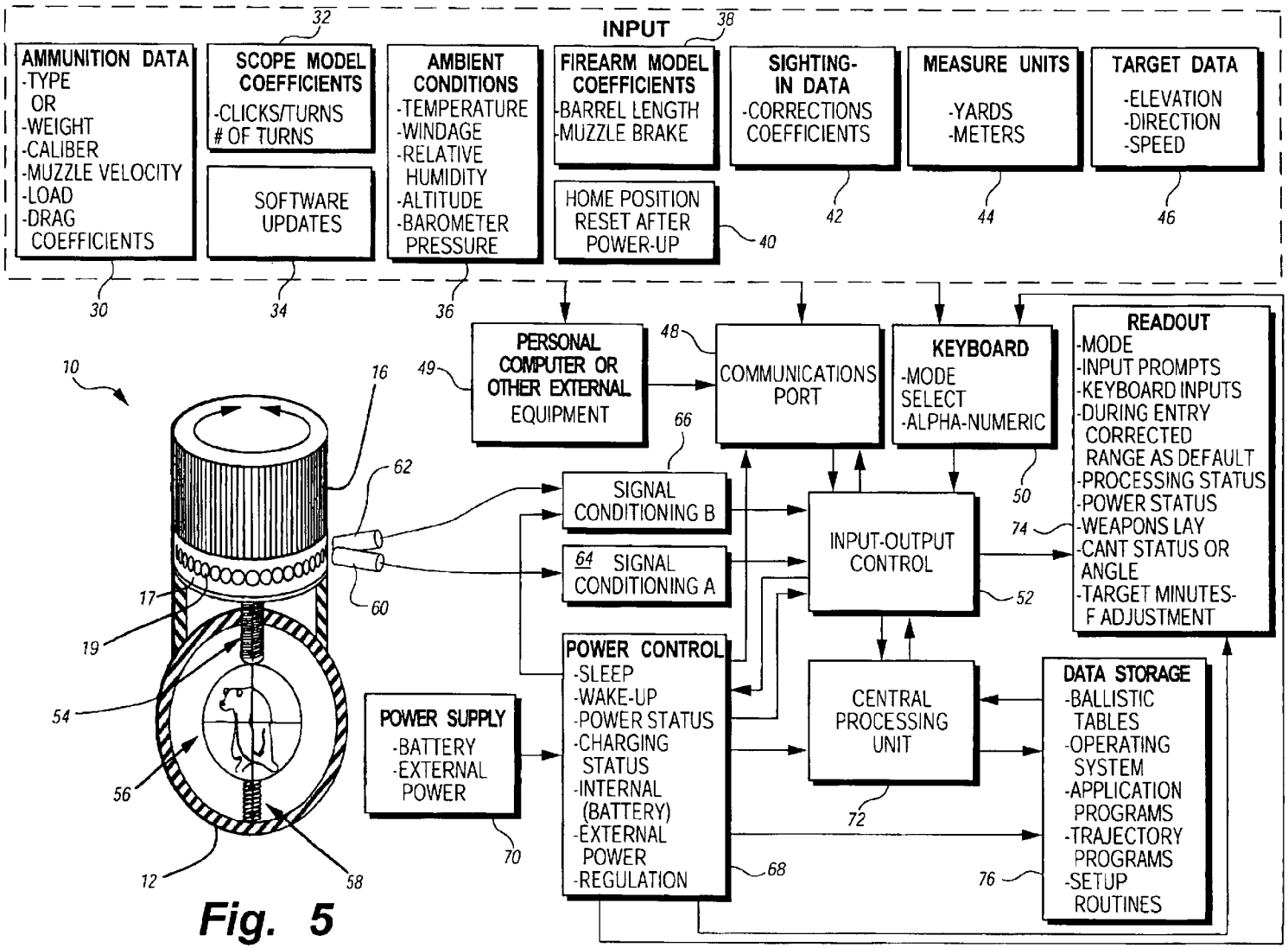
FIG. 5 is a block diagram of the data input and output of the digital elevation knob and a partial perspective view of the device.

A plurality of push buttons 26, are positioned in a lower portion of the microcomputer 22 for selection of multiple functions and entering of numerical parameters explained in detail in FIG. 5. The microcomputer 22 also contains a displacement sensor signal reader for conditioning the signals from the sensor, a unit containing an elevation program for different calibers, and an external interface plug-in socket 28 on one side (FIG. 3), whereby a rifleperson can enter data into the microcomputer 22 to obtain the optimum elevation setting for shooting the rifle at a specific target. The interface plug-in socket 28 (or any wireless interface accessory) is utilized to upload programs from a personal computer to the programmable microcomputer 22 of the device 10 and download firing data to the personal computer or other device. Conventional ballistic programs are available by Sierra, Oehler, and PRODAS, which can be incorporated.

Figure 6:
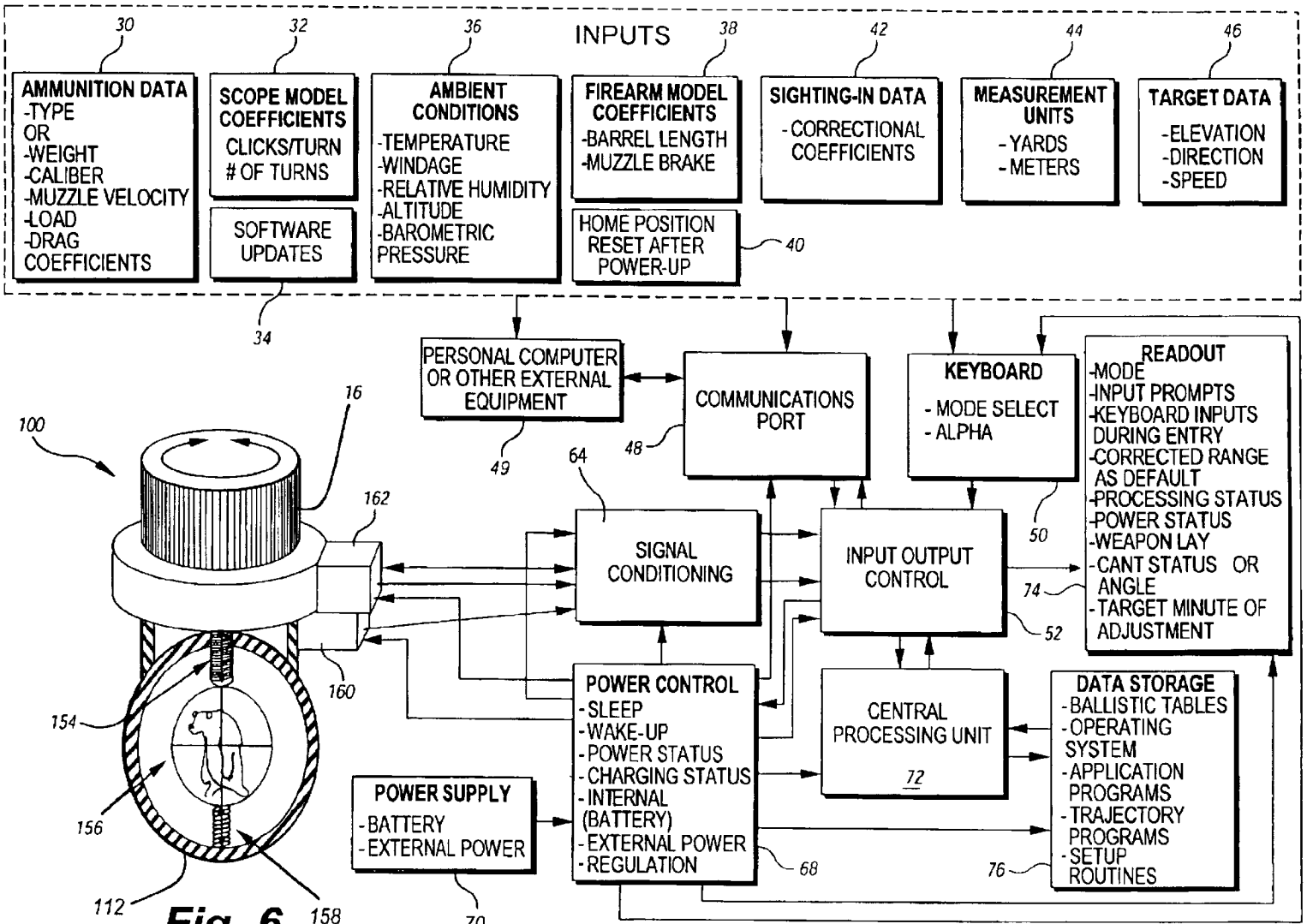
FIG. 6 is a block diagram of the data input and out put of the digital elevation knob and a partial perspective view of the device according to a preferred embodiment of the present invention.

FIGS. 5 and 6 describe the input parameters that are entered into the microcomputer 22 of the digital elevation knob device 10. The input parameters 30 to 46 are entered into the microcomputer 22 through either the communications port 48 or a keyboard 50. The keyboard 50 enters the input data as alpha-numeric characters and also selects the particular mode that the device is set in. Input data may also be entered into the microcomputer 22 from a personal computer or other external device 49. The personal computer 22 is coupled to the microcomputer 22 through the interface socket 28 and then transfers data through the communications port 48.

The first data inputted is ammunition data 30 which accepts specific ammunition data such as (1) type of ammunition or more specific data as (2) weight of the bullet, (3) caliber or diameter of the bullet, (4) muzzle velocity of the bullet, (4) powder load in the cartridge, and (5) drag coefficient of the bullet when fired in the barrel.

A second input 32 requires the scope model coefficients such as (1) the number of clicks per turn, and (2) the number of turns required.

A third input 34 associated with the second input 32 enters periodic updated software data.

A fourth input 36 requires the inputs of ambient conditions during firing such as (1) temperature, (2) windage in compass direction and velocity of the wind, (3) relative humidity, (4) altitude, and (5) barometric pressure.

A fifth input 38 enters firearm coefficients such as (1) barrel length and (2) muzzle brake.

A sixth input 40 resets the home position during the hunt after powering up the microcomputer 22.

A seventh input 42 enters sighting-in data such as correctional coefficients when the user is off the mark during practice.

An eighth input 44 enters what measurement units are employed such as yards or meters.

A ninth input 46 enters target data such as (1) elevation of the target, (2) direction of the target, and (3) speed of the target.

FIG. 5 also depicts a partial perspective view of the digital elevation knob device 10 according to a first embodiment. The present elevation knob 16 operates analogously to a conventional linear caliper device, such as that described in U.S. Pat. No. 4,543,526, issued Sep. 24, 1985 to Burckhardt et al., having a fixed magnetic tape on a bar over which a slider unit is disposed, the slider unit having a display screen, a magnetic tape reader, and a microcomputer for calculating linear displacement. However, in the present invention the digital magnetic tape 17 on the ribbed knob element 16 slides by the fixed magnetic tape reader in the microcomputer 22, which measures angular or radial displacement.

In use, the elevation adjuster knob or ribbed knob element 16 is rotated to rotate the digital magnetic tape element 17 having a magnetized region 19. An elevation adjuster screw 54 is manipulated for correct direction on the rifle (not shown) viewing through the cross hairs in the erector tube 56, which is supported by a position return spring 58. The magnetic tape element 17 measures the displacement of the erector tube 56.

The magnetic flux from the peripherally arranged digital magnetic tape 17 on the elevation adjuster knob 16 is transmitted to a magnetic flux transducer A 60 and a transducer B 62. Transducer A 60 transmits its signal to a signal conditioning unit A 64, and transducer B 62 transmits its signal to a signal conditioning unit B 66, wherein both signal conditioning units transmit their signal to the input-output control 52.

FIG. 6 depicts a partial perspective view of the preferred embodiment of the present invention. The digital elevation device 100 of the present embodiment uses alternate sensors as opposed to the magnetic elements of the previous embodiment. An optical element 156 is housed inside of the scope tube 112. The optical element is supported by a position return spring 158.

The user of the rifle turns the elevation knob 16, which then turns the adjuster push screw 154. Turning the screw 154 causes the optical element 156 to move up and down. The displacement of the optical element 156 is measured by an optical element feed back sensor 162. The sensor 162 sends a signal to a signal conditioning unit 64 in the microcomputer 22. The signal notifies the microcomputer the amount that the knob 16 has turned. The microcomputer 22 can then determine the displacement of the optical element 156. The optical element feed back sensor 162 may be any type of suitable sensor for determining the displacement of the optical element 156 including, but not limited to, optical encoders, precision potentiometers, and absolute multi-turn sensors.

The device 100 further comprises a weapon lay sensor 160 located below the optical element feed back sensor 160. The weapon lay sensor 160 determines if the weapon is canted. The weapon lay sensor 160 senses if the barrel of the gun is raised or tilted so that proper adjustments can be made. If the weapon is canted the lay sensor 160 sends a signal to the microcomputer 22, which activates a status light on the display screen 24 that informs the user that the weapon is canted.

Referring to FIGS. 5 and 6, a schematic drawing is shown depicting the path of the signals once they are transmitted from the sensors 160,162 or the transducers 60,62 into the microcomputer 22. Once the signal enters the microcomputer 22 it is sent to a signal conditioning unit 64,66. The signal conditioning unit 64,66 formats the signals so that they can be read by the central processing unit 72. The signal conditioning unit 64,66 can perform several functions including, but not limited to, converting a signal from analog to digital, regulating signals, filtering signals and amplifying signals.

The signal is next transferred to an input/output control unit 52. The control unit 52 controls the timing and flow of the input and output data in the microcomputer 22. The input/output control 52 transmits signals to the power control element 68, the communications port 48, the central processing unit 72, and a readout unit 74.

The central processing unit 72 receives input data and conditioned signals from the input/output control 52. The central processing unit 72 processes the input data and signals using information retrieved from the data storage unit 76. The data storage unit 76 contains ballistic tables, operating system data, and application programs for trajectory and setup routines. Once the data is processed the central processing unit 72 transfers processed data to a readout unit 74 through the input/output unit 52.

The readout unit 74 receives processed data from the central processing unit 72 as well as a power control unit 68 and the signal conditioning unit 64. The readout unit 74 supplies information to the display screen 24, which displays the information to the rifleperson. The readout unit 74 supplies information on the mode setting, input prompts, keyboard inputs during their entry, processing status, corrected range status, and power status. The power status is displayed by retrieving information from the power control unit 68. The power control unit 68 controls the status of the device 10. The power control unit 68 can put the device into a sleep, wake-up, power, or charging mode. The power control unit 68 controls the signal conditioning units 64,66, the communication port 48, the keyboard 50, the input/output control 52, the central processing unit 72, the readout unit 74 and the data storage unit 76. The power control element 6B is energized by a power supply 70, which is either an internal battery or an external D.C. power source.

This integrated system of inputs and the related functions shown in FIG. 5 enables a rifleperson to accurately sight his/her telescopic sight on the specific rifle, or other type of gun, and ammunition used for the variables shown. With the present widespread use of personal computers and other electronic data devices, this invention can be used in concert with present state of the art devices to decrease the time and effort required to calibrate the riflescope. Thus, it has been shown that the present invention improves the use of prior art elevation knobs which have engraved or painted graduation marks requiring a separate ballistic sheet to indicate adjustment of the scope for each caliber, bullet velocity, temperature, and other parameters.

It is to be understood that the present invention is not limited to the present embodiments described above, but encompasses any and all embodiments within the scope of the following claims.

I claim:

1. A digital elevation knob device, comprising:

a generally cylindrical, rotating ribbed knob;

a non-rotating generally cylindrical scope mount having a longitudinal axis coincident with that of said ribbed knob, and a longitudinally arranged pair of flanges, said scope mount being adapted and configured for receiving said ribbed knob and mounting said knob to a rifle scope; and a computer housing, said housing comprising a programmable computer, a display screen disposed on an upper front portion of said housing for indicating readout data, a plurality of push buttons disposed on a lower front portion of said housing for selection of functions and entering of numerical parameters, an interface plug for receiving an exterior data entry device, and a power source;

whereby a rifleperson can enter data into the computer to obtain the optimum elevation setting for firing the rifle at a target.

2. The digital elevation knob device according to claim 1, further comprising a target viewing element disposed inside of the tube of the rifle scope, a target adjuster screw secured to the bottom of said knob and positioned above the target viewing element, a positioning spring disposed beneath and supporting the target viewing element and a displacement sensing element for determining the displacement of the target viewing element.

3. The digital elevation knob device according to claim 2, wherein said displacement sensing element is selected from the group consisting of a magnetic tape coupled to a pair of magnetic flux transducers, optical sensors, optical encoders, precision potentiometers and absolute multi-turn sensors.

4. The digital elevation knob device according to claim 2, further comprising a weapon lay sensor located proximate to said displacement sensing element, wherein said weapon lay sensor determines if the rifle is canted or inclined.

5. The digital elevation knob device according to claim 1, wherein said display screen is selected from the group consisting of liquid crystal display screens, laser emitting diode screens and plasma screens.

6. The digital elevation knob device according to claim 1, wherein said power source is selected from the group consisting of internal batteries and external D.C. power sources.

7. The digital elevation knob device according to claim 1, wherein said programmable computer further comprises:

a communications port for receiving input data in said computer;

at least one signal conditioning unit for receiving and formatting signals delivered to the programmable computer from the displacement sensing element and the weapon lay sensor;

an input and output control unit that controls the timing and flow of input data and output data in the programmable computer;

a data storage unit for storing ballistic tables, operating system data, and application programs for trajectory and setup routines;

a central processing unit for receiving processing input data and conditioned signals from the control unit and processing the input data with stored data retrieved from the data storage unit;

a power control unit for controlling the settings of the knob device, wherein the power control unit can change the status of the knob device to a sleep mode, a charging mode, a wake-up mode and a power mode, and regulates the power supplied by said power source; and a readout unit that supplies readout information to said display screen;

whereby the input control transmits signals and data to the power control unit, the communications port, the central processing unit and the readout unit.

8. The digital elevation knob device according to claim 1, wherein said computer housing is attached to said scope mount between the pair of flanges.

9. A method of calibrating the telescopic scope of a rifle using a digital elevation knob, comprising the steps of:

entering input parameters in a programmable computer mounted to the telescopic scope using a communication port and a keypad;

adjusting a target viewing element disposed inside of the telescopic scope and transferring a signal containing the degree of displacement of the target viewing element to the programmable computer;

processing the signal and the input parameters entered into the programmable computer; and displaying processed information to the user of the telescopic rifle scope;

whereby the user of the telescopic rifle scope is supplied with information to properly adjust the telescopic rifle scope to accurately sight a specific target.

10. The method according to claim 9 wherein said entering input parameters step further comprises the steps of:

entering ammunition data comprising type of ammunition, weight of bullet, caliber of bullet, muzzle velocity of bullet and drag coefficient of bullet when fired;

entering scope model coefficients;

entering periodic updated software data;

entering ambient conditions data comprising temperature, wind velocity in compass direction, relative humidity, altitude and barometric pressure;

entering firearm coefficients comprising barrel length and muzzle break;

resetting the home position after the programmable computer is charged;

entering correctional coefficients if the user is off the mark during target practice;

entering measurement units; and entering target data comprising elevation of target, direction of target and speed of target.

11. The method according to claim 9 wherein said target viewing element adjustment step further comprises:

rotating an adjuster knob that in turn rotates an adjuster screw positioned above the target viewing element;

determining the displacement of the target viewing element with a displacement sensing element; and transferring the displacement signal from the displacement sensing element to the programmable computer.

12. The method according to claim 9 further comprising the step of measuring the cant of the firearm with a weapon lay sensor and transmitting a cant signal and a rifle inclination signal to the programmable computer.

13. The method according to claim 9, wherein said processing step further comprises:

formatting the signals in a signal conditioning unit so that the signals may be read by a central processing unit;

transferring the formatted signals to the central processing unit through an input and output control unit;

transferring the input parameters to the central processing unit through the input and output control unit; and processing the signals and input parameters with information retrieved from a data storage unit, said information comprising ballistic tables, operating system data, and application programs for trajectory and setup routines.

14. The method according to claim 9 further comprising the step of receiving input data from an external data source through an interface socket disposed on the programmable computer.

15. The method according to claim 14 further comprising the step of transmitting output data to the external data source through the interface socket.

16. A digital riflescope device comprising:

a telescopic sight for a gun having a scope tube and a target viewing element disposed inside of the scope tube;

a horizontal adjustment knob disposed along the side of said telescopic sight for making wind and sight adjustments;

a generally cylindrical, rotating ribbed knob;

a non-rotating generally cylindrical scope mount having a longitudinal axis coincident with that of said ribbed knob, and a longitudinally arranged pair of flanges, said scope mount being adapted and configured for receiving said ribbed knob and mounting said knob to a rifle scope; and a computer housing comprising a programmable computer, a display screen disposed on an upper front portion of said housing for indicating readout data, a plurality of push buttons disposed on a lower front portion of said housing for selection of functions and entering of numerical parameters, an interface plug for receiving an exterior data entry device, and a power source;

whereby a rifleperson can enter data into the computer to obtain the optimum elevation setting for firing the gun at a target.

* * * * *